United States Patent [19]

Usel

[11] 4,213,392

[45] Jul. 22, 1980

[54] ELECTRICALLY IGNITABLE CARTRIDGE-LESS BULLET

[76] Inventor: Hubert Usel, A-6401, Inzing, Tirol, Austria

[21] Appl. No.: 817,120

[22] Filed: Jul. 18, 1977

Related U.S. Application Data

[63] Continuation of Ser. No. 785,098, Apr. 6, 1977, abandoned, which is a continuation of Ser. No. 527,289, Nov. 26, 1974, abandoned, which is a continuation of Ser. No. 327,217, Jan. 26, 1973, abandoned.

[30] Foreign Application Priority Data

Jan. 28, 1972 [AT] Austria ..... 679/72

[51] Int. Cl.[2] ..... F42B 9/00

[52] U.S. Cl. ..... 102/38 R; 102/38 CC; 102/46

[58] Field of Search ..... 149/63, 96; 102/38 R, 102/28, 46, 38 CC

[56] References Cited

U.S. PATENT DOCUMENTS

| | | | |
|---|---|---|---|
| 3,019,732 | 2/1962 | Kaspaul | 102/28 |
| 3,118,375 | 1/1964 | Jasse | 102/46 X |
| 3,198,117 | 8/1965 | Purdy et al. | 102/28 |
| 3,211,096 | 10/1965 | Forney et al. | 102/28 |
| 3,292,537 | 12/1966 | Goss, Jr. | 102/28 |
| 3,336,871 | 8/1967 | Quinlan | 102/38 |
| 3,563,177 | 2/1971 | Ritchey | 102/46 |
| 3,608,492 | 9/1971 | Mitchell | 102/38 |
| 3,673,286 | 1/1970 | Remaly | 149/63 |
| 3,723,203 | 3/1973 | Craig | 149/63 |
| 3,795,195 | 3/1974 | Irish, Jr. et al. | 102/DIG. 1 |

FOREIGN PATENT DOCUMENTS

| | | | |
|---|---|---|---|
| 1140604 | 1/1969 | United Kingdom | 102/46 |

OTHER PUBLICATIONS

Explosive "D" Military Explosives TM9, 1910 to 11 A-1-34, Apr. 1955 p. 164.

*Primary Examiner*—Harold J. Tudor
*Attorney, Agent, or Firm*—Michael J. Striker

[57] ABSTRACT

A bullet is composed of a projectile and a propellant charge, and an electrode-free firing cap is provided upon the bullet and fires the bullet upon the application of an electric ignition current.

16 Claims, 6 Drawing Figures

ELECTRICALLY IGNITABLE CARTRIDGE-LESS BULLET

This is a continuation of application Ser. No. 785,098, filed Apr. 6, 1977, now abandoned which is a continuation of application Ser. No. 527,289 filed Nov. 26, 1974 (now abandoned) which in turn was a continuation of Ser. No. 327,217 Jan. 26, 1973 (now abandoned).

BACKGROUND OF THE INVENTION

The present invention relates to an ammunition in general and more particularly to a cartridge-less bullet. Still more particularly, it relates to a cartridge-less bullet which can be electrically fired.

Bullets without cartridges have already been developed, the impetus being the rather high weight of the cartridge casing and the expense thereof. It was reasoned that both the weight and the expense could be eliminated if it were possible to eliminate the cartridge. Development in this field has resulted in various cartridge-less bullet constructions of which two types have been found heretofore quite acceptable, namely, a type having a solid charge and a percussion firing cap, and another type having a charge of compressed gunpowder which has to be ignited by means of compressed air that is produced in the weapon itself.

It is known that it has also been repeatedly attempted to provide cartridge-less bullets which could be electrically ignited, i.e., fired. It was suggested to adhere a thin metal foil to the rear end of the explosive charge of the bullet and to burn through this foil by means of two electrodes through which a current is passed, thereby igniting the propellant charge. Wire bridges have also been suggested for the same purpose.

However, heretofore none of these suggestions for electrical firing have been found feasible. Where the foil has been used it has been found that an extremely high currnt was required to obtain the desired result. Where the wire bridge was used there was insufficient certainty of electrical contact. In any case, however, the main objection has been that metallic deposits on the electrodes cause difficulties leading to a non-reliable operation of a weapon which uses such bullets.

Another field in which electrical firing has been used for some time now are blasting caps and the like. Here, firing caps have been used which contain mixtures of conductive materials and explosive materials, such as lead styphnate, copper acetylide or lead azide. These caps are fixedly connected with the electrodes which are in turn connected with the ignition charge and are either destroyed after use (as in the case of blasting caps) or must be subsequently removed (as in the case of electrically fired bullets having cartridges where the use of such type of caps is also known). In either case it is of no importance whether the conductive materials and the explosive materials used tend to form deposits on the electrodes or not, because the electrodes are not and cannot be re-used.

The matter is different in the case of cartridge-less bullets which are to be electrically fired, because in this instance the ignition electrodes are a part of the firing weapon and remain there, being required to remain operative for thousands of rounds of ammunition. For this reason the use of cartridge-less bullets must never under any circumstances lead to fouling of the electrodes, as by the deposits of material on them. Furthermore, it is necessary that this type of ammunition be unaffected by blows, by friction and by moisture despite the fact that it is exposed, unlike conventional ammunition which is protected in the cartridge.

SUMMARY OF THE INVENTION

It is, accordingly, a general object of the present invention to provide an improved electrically ignitable cartridge-less bullet which avoids the disadvantages of the prior art.

More particularly it is an object of the present invention to provide such an improved bullet which meets the requirements outlined above.

Another object of the invention is to provide such a bullet which does not cause the deposition of matter on the firing electrodes of the weapon in which the bullet is used.

An additional object of the invention is to provide such a bullet which has a charge which will burn without leaving deposits and whose rate of combustion is regulatable.

In keeping with these objects, and others which will become apparent hereafter, one feature of the invention resides in an electrically ignitable cartridge-less bullet which, briefly stated, comprises a bullet composed of a projectile and a propellant charge. The bullet has a rear end wall surface and a circumferential surface, and there is further provided electrode-free igniting means provided on at least one of these aforementioned surfaces for purposes of igniting the charge in response to the application of an electric ignition current.

The novel features which are considered as characteristic for the invention are set forth in particular in the appended claims. The invention itself, however, both as to its construction and its method of operation, together with aditional objects and advantages thereof, will best be understood from the following description of specific embodiments when read in connection with the accompanying drawing.

DESCRIPTION OF THE PREFERRED EMBODIMENTS

Figure 1:
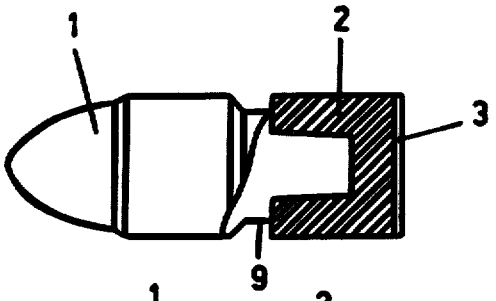
FIG. 1 is a partly sectioned partly side-elevational view of a bullet according to the present invention.

Discussing firstly FIG. 1 of the drawing in detail, it will be seen that the bullet illustrated there has a projectile 1, an ignition or explosive charge 2 which propels the projectile when ignited, and an electrode-less ignition or firing cap 3. As FIG. 1 shows, the projectile is—in contrast to the usual projectile configuration—provided with a projection extending from the rear end of the projectile, and this projection is slightly conical in configuration. The propellant charge 2 is pressed onto and about the projection which retains it in place.

The embodiment of FIG. 2, wherein like reference numerals designate like elements, illustrates a similar construction which differs in the manner in which the firing cap 3 is applied and will be discussed later.

Figure 2:
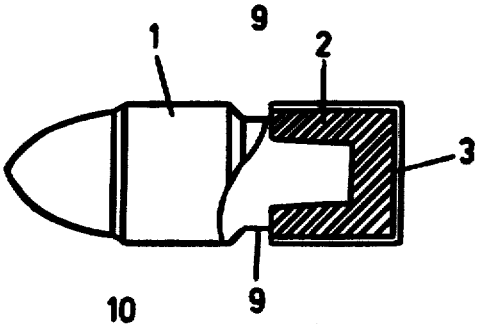
FIG. 2 is a view similar to FIG. 1 but illustrating a further embodiment of the invention.
Figure 3:
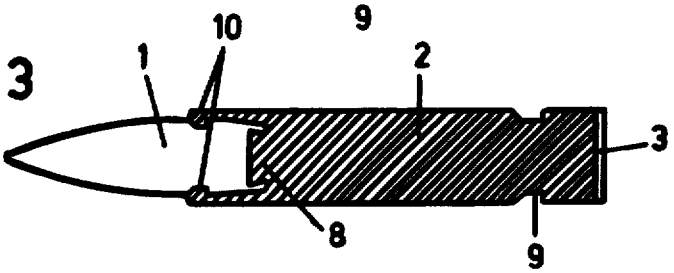
FIG. 3 is a view similar to FIG. 2 illustrating an additional embodiment of the invention.

In FIG. 3, however, I have illustrated an embodiment in which the projectile 1 is provided with a circumferential groove located somewhat forwardly of its rear end, rather than being provided with the conical projection of the embodiments of FIGS. 1 and 2. The propellant charge 2 is here shaped differently from those of FIGS. 1 and 2 and in part surrounds the rear end of the projectile 1, up to the circumferential groove. The propellant charge 2 is provided with an annular inwardly extending bead 10 which is located in the groove and which thus serves to hold the charge 2 on the projectile 1. The rear end of the projectile 1 is provided with an annular collar the interior cross-section of which converges rearwardly as shown, and some of the charge 2 is located in this collar forming a projection 8 which is retained therein. This makes for a reliable retention of the charge 2 on the projectile 1. Unlike FIGS. 1 and 2 where the groove 9 is located between the charge 2 and the actual projectile 1, the embodiment of FIG. 2 has the groove 9 located adjacent the trailing end or rear end of the charge 2.

Figure 4:
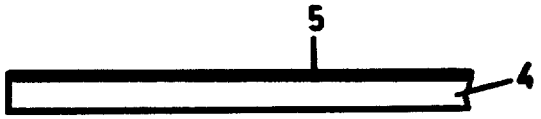
FIG. 4 is a fragmentary side-elevational view illustrating details of the construction of a firing cap used in any of these preceding bullets.
Figure 5:
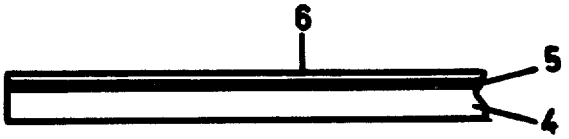
FIG. 5 is a view similar to FIG. 4 illustrating a different construction of the firing cap.
Figure 6:
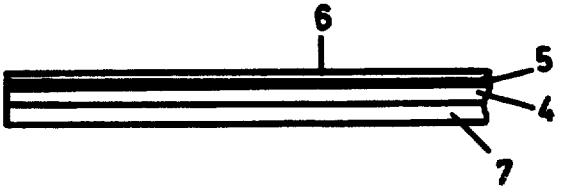
FIG. 6 is a view similar to FIG. 6 illustrating yet an additional construction of the firing cap.

The ignition or firing cap 3 may be of any of the types illustrated in FIGS. 4, 5 or 6. It will be seen that the configuration of the cap 3 differs in FIGS. 1-3, being essentially the same in FIGS. 1 and 3 except for the size, but being of different configuration in FIG. 2.

If the firing cap is of the type shown in FIG. 4 it will be seen that it is composed of an ignition layer 4 and a contact layer 5. The ignition layer in this embodiment is composed of nitrocellulose and potassium picrate. It is not absolutely necessary, but if desired in order to improve the oxygen balance, an oxygen carrier such as barium nitrate can be added to the material of the layer 4. The components are thoroughly kneaded together, with a solvent for nitrocellulose such as acetone or ether-alcohol, and subsequently are rolled to form a ribbon or layer whose thickness is approximately 0.3 mm. After the layer is partially or completely dried it is provided with a contact layer 5; to obtain a uniform layer thickness, this is done with a so-called layering machine which is well known in the art.

The contact layer itself is of nitrocellulose which serves as a binder, and of crystalline antimony which is admixed with amorphous antimony. The latter is provided in order to impart to the layer 5 semiconducting characteristics; due to its distribution throughout the layer 5 the semiconducting characteristics imparted to the layer insure that current paths which are formed upon the application of electrical current and which have a higher electron density as a result of thermal electron acceleration will undergo a much more rapid heating than current paths which are adjacent to them but have a lower electronic density. This effect means that, to initiate the ignition, only a very small portion of the contact layer surface between the electrodes must be heated by electrical energy, not the entire surface. This, in turn, means that the electrical current required for causing the ignition of the charge 2 is very low.

To increase the combustion temperature and the ignition effect, the antimony may be admixed with an explosive component, such as barium picrate or potassium picrate.

To produce the layer 5, the cellulose is first dissolved in a solvent such as acetone, and thereupon the other components are added to this solution. After thorough admixture the mix thus obtained is applied in liquid or paste form on the layer 4 to a thickness of approximately 0.01 mm.

In the embodiment of FIG. 5 the ignition cap has the layer 4, the layer 5 and an additional outer layer 6 which is composed of antimony semiconductor bodies and nitrocellulose. The layer 4 is the same as described with respect to FIG. 4. The semiconductor contact layer 5, however, has a higher electrical conductivity by changing the quantity ratio of amorphous antimony and crystalline antimony. The layer 6 has a very particular characteristic, namely, it is incapable of electrically conducting in parallelism with the plane of the layer. This characteristic is obtained by interposing an electrically insulating filler material, such as nitrocellulose, or other insulating matter, between the semiconductor bodies so that flow of electrical current from the electrode supplying it (not shown) will take place via the semiconductor bodies of the layer 6 axially to the layer 5 which is beneath it. During such flow at several points of contact between the semiconductor bodies of the layer 6 and those of the layer 5 a heating zone of very localized dimensions will result, which causes a further decrease in the amount of electrical current required for obtaining ignition.

FIG. 6, finally, shows a firing cap construction having a base foil or layer 7 of solid or porous nitrocellulose; the foil 7 serves only as a carrier for a substantially thinner layer 4 which for small-caliber ammunition will provide sufficient ignition energy if it has a thickness of 0.1 mm.

As FIGS. 1 and 3 show, the firing cap constructed in accordance with any of FIGS. 4-6, may be provided on the rear end wall surface of the charge, or it may be provided as shown in FIG. 2 in form of a cup or sleeve or jacket surrounding both the rear end wall and the outer circumferential surface of the charge.

It has been pointed out before that semiconductor materials based on the aforementioned antimony modifications can be used in constructing the firing caps of FIGS. 4-6. In their place, however, it is possible to use other semiconductor systems such as metal sulfides phosphides, silicides and borides. Of the sulfides I have found that iron sulfide is a particularly good semiconductor component for the purposes in question.

The ignition charge or propellant charge 2 of the embodiment in FIGS. 1-3 is mainly composed of nitrocellulose with a nitrogen content of approximately 13%. In order to provide a sufficient burning or ignition speed the charge must be porous, but on the other hand its porosity must not exceed a certain value because otherwise an excessive reduction in the mechanical strength will be the result, coupled with a simultaneous increase in the tendency to absorb moisture. To improve and regulate the combustion speed of the charge I propose to accomodate in the pores of caverns of the nitrocellulose body appropriate oxygen carriers, such as barium nitrate or potassium nitrate. In their place I can also use quick-burning explosive material, such as ammonium picrate or potassium picrate.

The charge is made porous by dissolving a pore-forming material out of pre-formed nitrocellulose bodies at boiling temperature. Because of this the usually water-soluble accelerating material which is to be accommodated in the pores (see above) must be introduced after the basic nitrocellulose body has been boiled to remove the pore-forming material. This can be done by for instance introducing the porous nitrocellulose body into a hot 1% potassium picrate solution and causing it to become thoroughly impregnated with the solution by alternately subjecting it to vacuum and pressure. Subsequently, the impregnated charge is removed out of the solution and is cooled to room temperature which results in the crystallization of potassium picrate in the pores. The residual solution which contains only a very small amount of potassium picrate is subsequently removed from the charge, for instance by centrifugal force.

It will be understood that each of the elements described above, or two or more together, may also find a useful application in other types of constructions differing from the types described above.

While the invention has been illustrated and described as embodied in an electrically ignitable cartridge-less bullet, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of the present invention and, therefore, such adaptations should and are intended to be comprehended within the meaning and range of equivalence of the following claims.

What is claimed as new and desired to be protected by Letters Patent is set forth in the appended claims:

1. An electrically ignitable cartridge-less bullet comprising a projectile having a rearwardly extending pin-shaped projection, said projection having a rear surface and a circumferential surface; a propellant charge connected to said projectile and having an internal surface and an external surface, said internal surface engaging said rear and said circumferential surfaces of said projection of the projectile; and a multi-layer firing cap provided on said external surface of the propellant charge and including at least one ignition layer adjacent said external surface of the propellant charge, and one semiconductive layer having one surface in contact with said ignition layer, said semiconductive layer being subjected to an electrical voltage differential when the bullet is to be fired so that discrete current paths in said semiconductive layer are rapidly heated during the passage of electric current, said multi-layer firing cap further including a second semiconductive layer having a surface in contact with a surface of said first-mentioned semiconductive layer opposite said one surface of the latter and being incapable of electrically conducting in parallelism with the plane of said second semiconductive layer so that a heating zone of very localized dimension will result during the passage of electrical current to thereby decrease the amount of electrical current for obtaining ignition.

2. An electrically ignitable cartridge-less bullet comprising a projectile; a propellant charge connected to said projectile and having an external surface; and a multi-layer firing cap provided on said external surface and including at least one ignition layer adjacent said external surface of said propellant charge, a first semiconductive layer having two opposite surfaces, a first of which being in contact with said ignition layer, said first semiconductive layer being subjected to an electrical voltage differential when the bullet is to be fired so that discrete current paths in said first semiconductive layer are rapidly heated during the passage of electric current, and a second semiconductive layer having one surface in contact with a second surface of said first semiconductive layer and being incapable of electrically conducting in parallelism with the plane of said second semiconductive layer so that a heating zone of very localized dimension will result during the passage of electrical current to thereby decrease the amount of electrical current required for obtaining ignition.

3. A bullet as defined in claim 2, wherein said charge in part surrounds said projectile, the latter having an outer annular groove and said charge being in part located in said groove; further comprising a conical projection on said charge in engagement with and retained by a portion of said projectile.

4. A bullet as defined in claim 2, wherein said first-mentioned semi-conductive layer is of a material selected from the group consisting of iron sulfide, phosphides, silicides and borides.

5. A bullet as defined in claim 2, wherein said first-mentioned semi-conductive layer is of nitrocellulose and amorphous antimony.

6. A bullet as defined in claim 2, wherein said first-mentioned semi-conductive layer is of nitrocellulose and fine-crystalline antimony.

7. A bullet as defined in claim 2, wherein said second semiconductive layer is composed of semiconductive bodies and an insulating binder material for the same.

8. A bullet as defined in claim 7, wherein said charge is composed of porous nitrocellulose, and an oxygen-carrier accommodated in the pores thereof and selected from the group consisting of barium- and potassium nitrate.

9. A bullet as defined in claim 7, wherein said charge is composed of porous nitrocellulose and a quick-burning explosive selected from the group consisting of ammonium- and potassium picrate.

10. A bullet as defined in claim 7, wherein said first-mentioned semiconductive layer is composed of metal sulfides.

11. A bullet as defined in claim 7, wherein said ignition layer is of nitrocellulose and potassium picrate.

12. A bullet as defined in claim 11, wherein said ignition layer further includes an oxygen carrier such as potassium nitrate.

13. A bullet as defined in claim 2, wherein said first-mentioned semiconductive layer is of nitro-cellulose, amorphous antimony and fine-crystalline antimony.

14. A bullet as defined in claim 13, wherein said first-mentioned semiconductive layer further comprises an explosive.

15. A bullet as defined in claim 14, wherein said ignition layer further includes an oxygen carrier such as barium nitrate.

16. A bullet as defined in claim 2, wherein said cap comprises a carrier layer of combustible material, such as nitrocellulose.

* * * * *